US006505817B1

(12) United States Patent
Witter

(10) Patent No.: US 6,505,817 B1
(45) Date of Patent: Jan. 14, 2003

(54) FRAMEWORK REMOVAL TOOL

(75) Inventor: Lowell F. Witter, 450 S. Belmont, Elgin, IL (US) 60123

(73) Assignee: Lowell F. Witter, Elgin, IL (US)

( * ) Notice: Subject to any disclaimer, the term of this patent is extended or adjusted under 35 U.S.C. 154(b) by 5 days.

(21) Appl. No.: 09/656,851

(22) Filed: Sep. 7, 2000

Related U.S. Application Data

(60) Continuation-in-part of application No. 09/146,935, filed on Sep. 2, 1998, now Pat. No. 6,186,479, which is a division of application No. 08/939,973, filed on Sep. 29, 1997, now Pat. No. 5,855,358.

(51) Int. Cl.[7] ..... B25C 11/00

(52) U.S. Cl. ..... 254/25; 254/30; 254/132

(58) Field of Search ..... 254/21, 23, 25, 254/26 R, 131, 132, 30, 31; 29/267

(56) References Cited

U.S. PATENT DOCUMENTS

| | | | | | |
|---|---|---|---|---|---|
| 486,300 | A | | 11/1892 | Scheid | |
| 977,986 | A | | 12/1910 | Waddell | |
| 1,313,758 | A | | 8/1919 | Taylor | |
| 1,514,060 | A | * | 11/1924 | McCallum | 254/25 |
| 1,961,050 | A | * | 5/1934 | Johnson | 254/25 |
| 1,999,174 | A | | 4/1935 | Jackson | |
| 2,087,148 | A | | 7/1937 | Hempy | |
| 2,424,929 | A | | 7/1947 | Haney | |
| 2,582,284 | A | | 1/1952 | Sarosdy | |
| 2,693,935 | A | | 11/1954 | Halbert | |
| 2,698,161 | A | * | 12/1954 | Kirby | 254/25 |
| D199,019 | S | * | 8/1964 | Marson | 254/25 |
| 3,815,875 | A | | 6/1974 | Koebel, Jr. | |
| 4,998,312 | A | | 3/1991 | Donaldson | |
| 5,022,632 | A | | 6/1991 | Beideck | |
| 5,224,687 | A | | 7/1993 | Geckler | |
| 5,547,168 | A | | 8/1996 | Kelly | |
| 5,722,141 | A | | 3/1998 | Strickland | |
| 5,799,113 | A | | 8/1998 | Witter | |
| 5,884,900 | A | * | 3/1999 | Gobeil et al. | 254/25 |

* cited by examiner

*Primary Examiner*—Robert C. Watson
(74) *Attorney, Agent, or Firm*—Brinks Hofer Gilson & Lione

(57) ABSTRACT

A framework removal tool is provided. A lever arm connects to a rounded extension. The lever arm is rotated to remove a stake or pry away framework. The rounded extension has a width wider than the bar. The rounded extension provides broad support for rotating the lever arm without damaging any concrete. A notch is provided in the rounded extension. The notch comprises an aperture along the width of the hollow cylinder shaped extension. The notch contacts framework or stakes for removal from set concrete. The framework is placed within the notch for removal.

22 Claims, 3 Drawing Sheets

FIG. 6
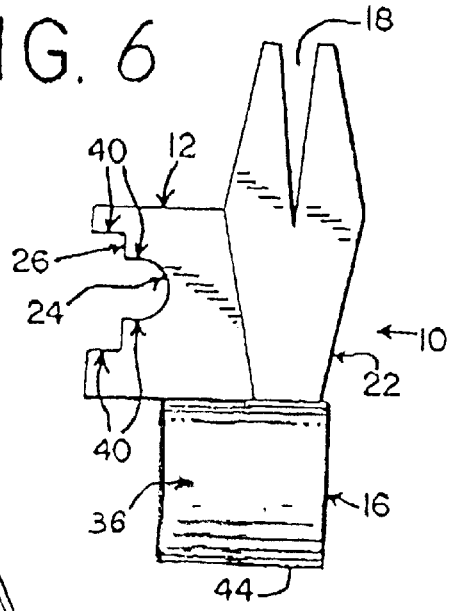
FIG. 7
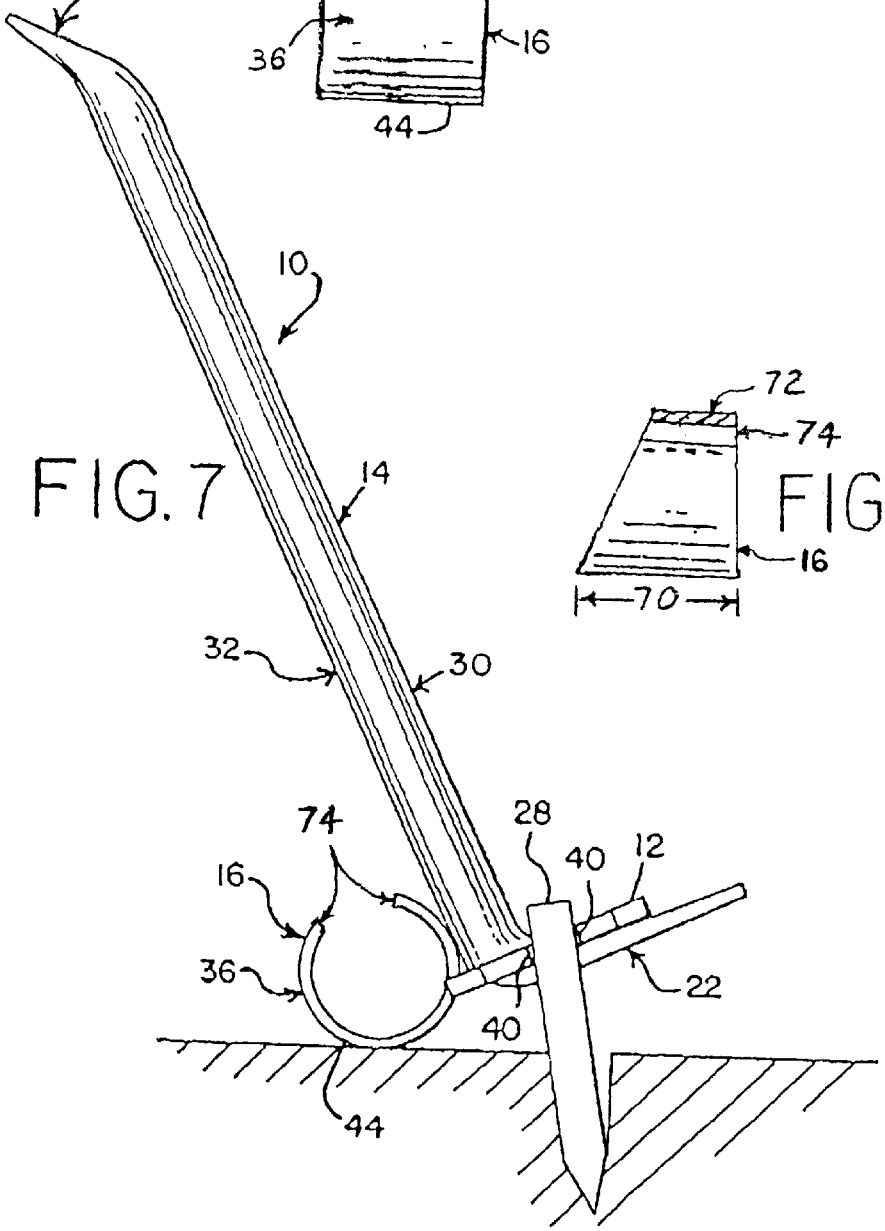
FIG. 8

FRAMEWORK REMOVAL TOOL

CROSS REFERENCE TO RELATED APPLICATION

This application is a continuation-in-part of U.S. patent application Ser. No. 09/146,935, filed Sep. 2, 1998, now U.S. Pat. No. 6,186,479 which is in turn a divisional Ser. No. 08/939,973 now of U.S. Pat. No. 5,855,358, filed Sep. 29, 1997. These applications and patents are hereby incorporated herein by reference in their entirety.

BACKGROUND OF THE INVENTION

The present invention relates generally to tools. More particularly, the invention relates to a tool for removing stakes of various sizes.

One use for stakes is to support concrete framework. The framework, such as wooden boards, is laid to contain the liquid concrete while the concrete hardens.

The stakes are driven into the ground adjacent the framework. The stakes hold the framework in place. Often nails are also used to hold the framework in place.

The stakes are of various constructions. In one example, the stakes are tubular metal lengths. The stakes may have a flattened head on one end and may have a point on the other end. As another example, the stakes are wood slats that taper from one end to the other. As yet another example, the stakes are wood boards. Stakes formed from plastic or other materials into various shapes are also known.

The cross-section of various stakes varies. For example, the wood slats or boards have a rectangular cross section, and the tubular metal lengths have a circular cross-section.

Once the stake is no longer necessary to support a structure, such as concrete framework, the stake is removed. The framework is also pried from the structure, such as the hardened concrete slab.

Various tools are known for removing stakes. For example, U.S. Pat. No. 4,998,312 discloses a tool for form stake removal. An elongated rod is attached to a bore. A round stake is placed into the bore. A fulcrum extension from the bore is placed onto the framework. The elongated rod is moved upward and pivots at the fulcrum extension. The bore grips the stake and pulls the stake upwards. The fulcrum extension is also used to pry framework.

U.S. Pat. No. 2,582,284 discloses a similar device, but the bore is replaced with a locking lug pivotally attached to the rod. The locking lug has a slot for engaging the round stake.

As another example, U.S. Pat. No. 3,815,875 discloses a portable stake remover. An arm is pivotally mounted on a base. One end of the arm has a jaw with a triangular opening. The opening is placed over round or L-shaped stakes. As the arm is rotated about the base, the stake is lifted upward. U.S. Pat. No. 2,424,929 discloses a similar device for removing posts. Furthermore, other devices use a plate for the jaw. The plate has a first opening on one side and a second opening on the other side. Each opening has a different shape.

Finally, U.S. Pat. No. 5,547,168 discloses an attachment for pulling stakes using a pry bar. The attachment slides over the end of the pry bar. The attachment has a notch on one side and a notch on a second side. The notch is placed around a stake, and the pry bar is rotated to move the stake.

However, none of the known devices provide for entirely satisfactory stake removal. In particular, many of the devices will not remove multiple types of stakes, many do not provide simple leverage design, and many are not capable of assisting in removal of framework material. Therefore, there is a need for an apparatus, which will assist in pulling nails, removing different types of stakes, provide convenient leverage, and assist in prying framework.

SUMMARY OF THE INVENTION

The present invention is defined by the following claims, and nothing in this section should be taken as a limitation on those claims. By way of introduction, the preferred embodiment described below includes an apparatus and method for pulling nails, prying framework and for removing different types of stakes using convenient leverage design. The framework removal tool comprises a first side of a stake contact element including first and second notches with first and second dimensions, respectively. A lever arm connects to the stake contact element. One of the first or second notches is selected based on a dimension of a stake. The selected notch is placed adjacent the stake. The lever arm is rotated to remove the stake.

In a first aspect, a rounded extension connects to the lever arm. The rounded extension has a width wider than the bar. The rounded extension provides broad support for rotating the lever arm without damaging any concrete.

In a second aspect, a notch is provided in the rounded extension. The notch comprises an aperture along the width of the hollow cylinder shaped extension. The framework is placed within the notch for removal from set concrete.

Further objects and attendant advantages are best understood by reference to the following detailed description in conjunction with the attached drawings.

BRIEF DESCRIPTION OF THE DRAWINGS

FIGS. 4A and 4B are referred to collectively as FIG. 4.

FIG. 6 is one embodiment of a bottom elevational view of the framework removal tool.

FIG. 7 is one embodiment of a right side elevational view of the framework removal tool of FIG. 6 with a stake partially removed.

FIG. 8 is one embodiment of a cross-section of a rounded extension of the framework removal tool of FIGS. 6 and 7.

DETAILED DESCRIPTION OF THE PRESENTLY PREFERRED EMBODIMENTS

Figure 1:
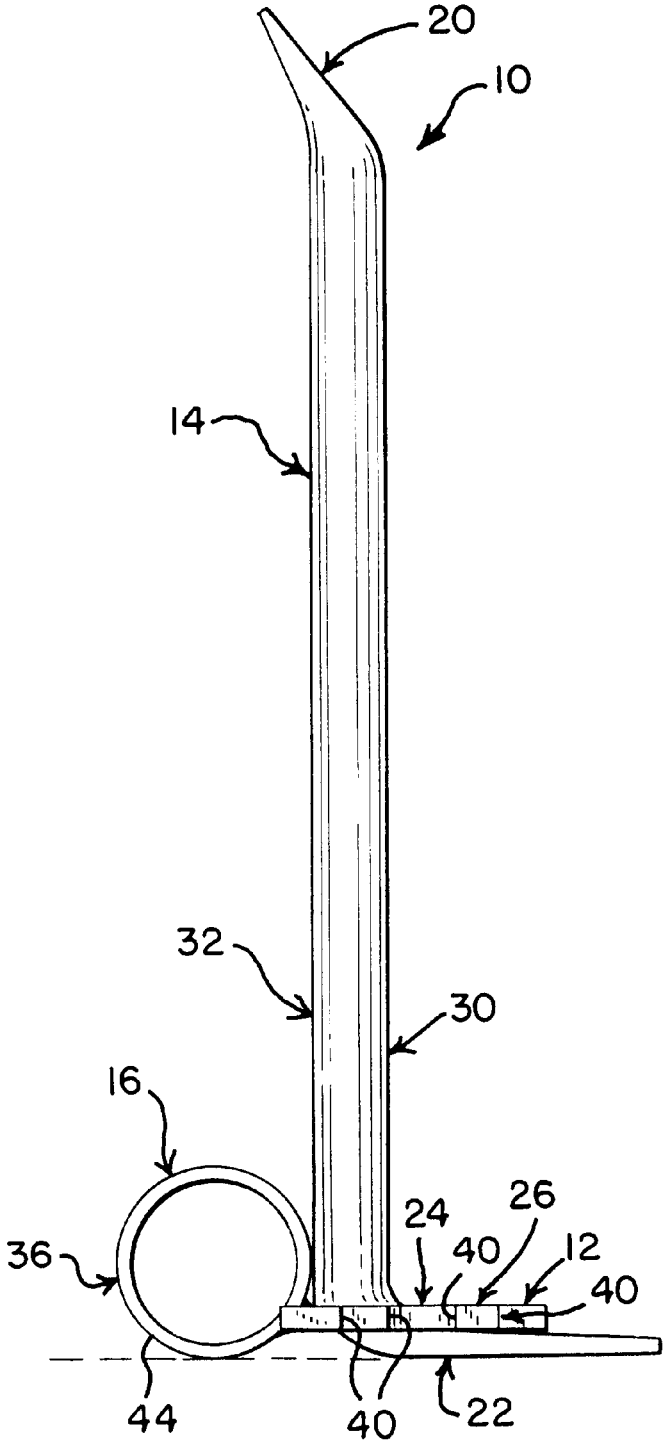
FIG. 1 is a right side elevational view of a framework removal tool.

Referring now to the drawings and more particularly to FIG. 1, the framework removal tool is generally shown at 10. The tool 10 includes a stake contact plate 12, a bar 14, and an extension 16.

Preferably, the bar 14 is a metal crow bar. Other structures and materials may be used. A taper end 20 is connected to one end of the bar 14. The taper end 20 and the bar 14 are constructed as one piece, as known in the art. The taper end 20 provides a flat edge for inserting between structures, such as concrete and framework. Preferably, the taper end 20 has a nail removal notch 19. The tapered end 20 may be made with or without the notch for removing nails. The taper end 20 connects to the bar 14 at a slight angle. The angle allows a user to insert a portion of the taper end 20 between two structures near a wall.

Figure 2:
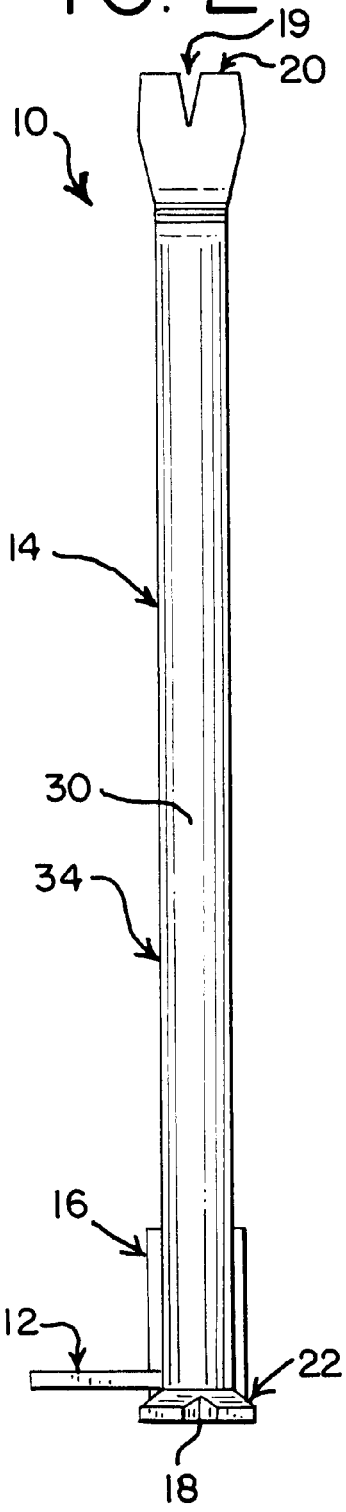
FIG. 2 is a front side elevational view of the framework removal tool of FIG. 1.
Figure 3:
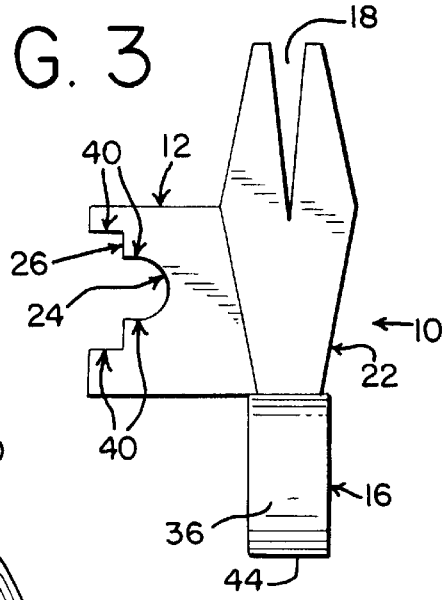
FIG. 3 is a bottom elevational view of the framework removal tool of FIG. 1.

A nail removal notch end 22 is connected to the bar 14 opposite the taper end 20. The nail removal notch end 22 is also constructed as one piece with the bar 14 and taper end 20. The nail removal notch end 22 connects to the bar 14 at an angle, such as 90°, and extends outward from a front side 30 of the bar 14. Referring to FIGS. 2 and 3, the nail removal notch end 22 has a nail removal notch 18. As known in the art, the nail removal notch 18 is designed to engage a nail for removal of the nail.

The extension 16 is attached to the bar 14 near the nail removal notch end 22. The extension 16 connects to the bar 14 on a backside 32, opposite the nail removal notch end 22, and on the right side of the bar 14 as described below. The extension 16 may connect to the tool 10 at other locations. The extension 16 is welded to the bar 14. Other methods of attachment are possible, such as constructing the extension 16 and bar 14 as one piece.

The extension 16 supports the tool 10 as the tool 10 is rotated about the extension 16. The extension 16 increases the distance from the notch 18 and the stake contact plate 12 to the point of rotation of the tool 10. The greater distance provided by the extension 16 increases the amount of torque applied to nails and stakes. Preferably, but not necessarily, the extension 16 is rounded along at least a portion of the outward face 36. As the tool 10 is rotated, the area of contact with the ground or other structure of the rounded outward face 36 moves along a portion of the circumference 44.

One structure for providing the rounded outward face 36 is a cylinder. Other structures with rounding along a lesser portion of the outer face 36 can be used. Preferably, the cylinder is hollow so that the weight of the tool 10 is reduced. The rounded outward face 36 allows for pulling a nail or stake, as discussed below, generally straight out of a board or ground. Furthermore, the rounded outward face 36 allows for even contact with the ground or other structure as the tool 10 is rotated. Preferably, the outward face 36 is flat from the left to right sides to provide a larger footprint. With the larger footprint, the extension 16 is less likely to sink into the ground or indent another structure as the tool 10 is rotated.

In one embodiment, the extension 16 has an extension width wider than a width of the bar 14. The rounded extension 16 provides broad support for rotating the lever arm without damaging any concrete. Furthermore, a larger surface is provided for hammering or for standing the tool.

FIGS. 6 and 8 show the extension 16 having an extension width 70. The extension width 70 comprises the width along a dimension that is substantially perpendicular to the length of the bar 14. The extension width 70 is wider than a width of the bar. For example, the extension width 70 is about twice as wide as the width of the bar.

FIG. 8 is a cross-sectional view of the rounded extension 16. The cross-section shown comprises a plane that is defined by a dimension parallel to the extension width 70 and the length of the bar 14. In one embodiment, the cross-section of the extension 16 has a trapezoidal shape. The extension width 70 comprises the widest width of the extension 16. The extension width 70 is positioned in the downward position or closest to the nail removal notch end 22, and a narrow width portion 72 is positioned closer to the taper end 20 than the nail removal notch end 22. In alternative embodiments, a uniform width for the extension 16 is provided. Other relative positions of the narrow width portion 72 and the extension width 70 may be used.

In one embodiment shown in FIGS. 7 and 8, a notch 74 is provided in the extension 16. The notch contacts framework or stakes for removal from set concrete. The framework is placed within the notch for removal.

The notch 74 comprises an aperture across the width of the extension 16. The notch 74 is parallel to the width dimension or the extension width 70. In embodiments where the extension 16 comprises a hollow cylinder shape, the notch 74 comprises a cutout along the cylinder. For example, the notch 74 is about two inches wide along the width of the cylinder, but other uniform or non-uniform cutouts with the same or different sizes may be used.

In one embodiment, the notch 74 is positioned on an upward portion of the extension 16, such as a portion closer to the taper end 20 than the nail removal notch end 22. The notch 74 is also positioned away from the bar 14 as shown. Other positions may be used.

Various combinations of the notch 74, the extension 16 with the extension width 70 wider than the width of the bar 14 and the stake contact plate 12 may be used. For example, the tool 10 comprises the bar 14 with just one of the three options. In other embodiments, two or more of these options are provided. As shown in FIGS. 6, 7 and 8, all of these options may be used.

Preferably, the stake contact plate 12 and the extension 16 are constructed as one piece from a sheet of metal, such as ½" by 2" steel plate. A punch press cuts the stake contact plate 12 and extension 16. The cut piece is then bent and machined to form the extension 16 and the stake contact plate 12. Alternatively, the stake contact plate 12 and extension 16 are constructed as separate parts. The extension 16 may be formed from cold drawn round steel or round pipe stock cut to length. The stake contact plate 12 may be made from steel plate cut to length and machined. Alternatively, the tool 10 may be molded as a one piece steel casting. The bar 14, stake contact plate 12, and extension 16 may be individual steel castings welded together. Other methods of construction may be used.

Referring to FIGS. 1–3, the stake contact plate 12 is bent relative to the extension 16 to position the stake contact plate 12 on a stake contact side 34 of the bar 14. Preferably, the stake contact plate 12 is placed just above, to one side of and behind the nail removal notch end 22. The nail removal notch end 22 also preferably extends further from the front side 30 than the stake contact plate 12. The stake contact plate 12 may be positioned at other locations relative to the tool 10. Once positioned, the stake contact plate 12 is welded to the bar 14 or otherwise connected to the tool 10 as discussed above.

Referring to FIGS. 3 and 4, two notches are on the stake contact plate 12. The notches have different dimensions and are on the same side of the stake contact plate 12. Preferably, the notches are cut as part of the punch press or milling operation and form an oblong notch 24 and a rectangular notch 26. Alternatively, the two notches may have identical shapes or other different shapes. One notch, such as the oblong notch 24, extends into the stake contact plate 12 further, but is narrower, than the other notch, such as the rectangular notch 26. Preferably, the narrower notch is centered in the wider notch. The two notches may be placed at other positions on the stake contact plate 12 or relative to each other.

Figure 4A:
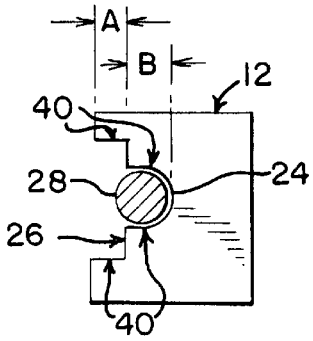
FIG. 4A is top elevational view of a stake contact plate adjacent a round stake.
Figure 4B:
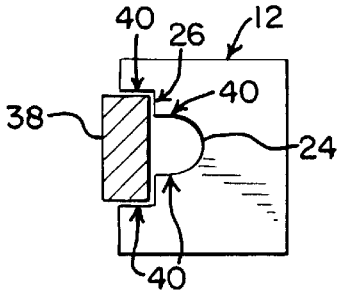
FIG. 4B is a top elevational view of the stake contact plate of FIG. 4A adjacent a rectangular stake.

As shown in FIG. 4A, the oblong notch 24 is shaped to fit around a portion of a round stake 28. Preferably, the oblong notch 24 is cut deeper than half the diameter of the typical round stake, such as round stake 28, from the greatest depth A of the rectangular notch 26. For example, the oblong notch 24 is cut to depth B. As shown in FIG. 4B, the rectangular notch 24 is shaped to fit around a portion of a rectangular stake 38. Preferably, the rectangular notch 24 is cut deeper than half the width of the typical rectangular stake, such as the rectangular stake 38, from the side of the stake contact plate 12.

Figure 5:
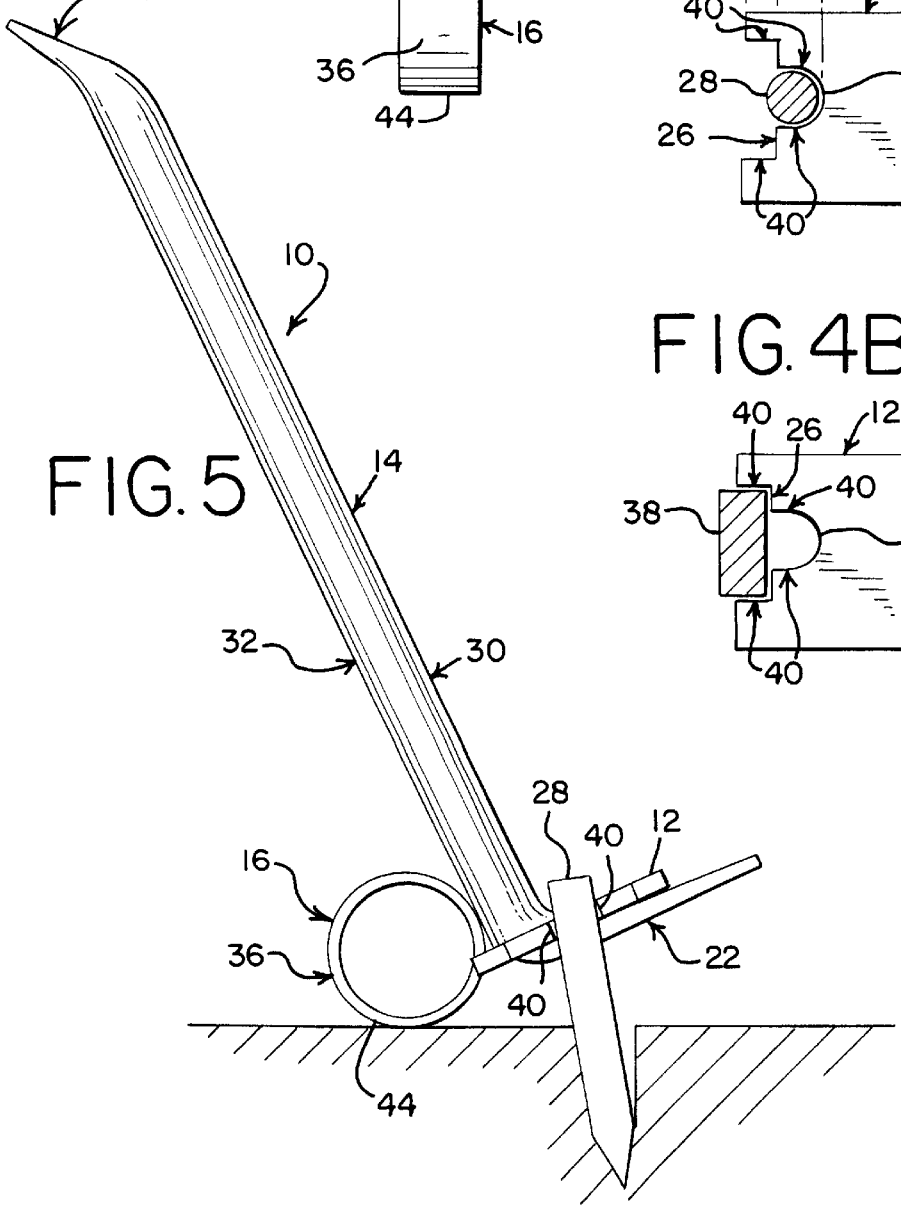
FIG. 5 is a right side elevational view of the framework removal tool of FIG. 1 with a stake partially removed.

Referring to FIGS. 4 and 5, a method for using the tool 10 is discussed below. To use the tool 10 to remove the round stake 28, the round stake 28 is positioned in the oblong notch 24. The nail removal notch end 22 and the extension 16 are placed on the ground or other support structure. The bar 14 is then used as a lever arm to apply force to the round stake 28. The taper end 20 of the bar 14 is rotated away from the round stake 28.

The outward face 36 of extension 16 acts as a pivot as the bar 14 is rotated. The oblong notch 24 and the nail removal notch 18 are lifted upward as the bar 14 rotates about the extension 16. Also as the bar 14 is rotated, the point of contact with the ground or other support structure moves along the outward face 36. The extension 16 causes the two notches 24, 26 and the nail removal notch 18 to rotate less away from horizontal as the bar 14 is rotated, less than they would without the extension 16. The lesser rotation from horizontal allows removal of stakes or nails without bending or breaking the nails or stakes.

As the oblong notch 24 is lifted upward, the stake contact plate 12 rotates away from horizontal. The rotation brings edges 40 of the oblong notch 24 into contact with the round stake 28. The edges 40 act to hold the round stake 28 in place relative to the oblong notch 24. As the oblong notch 24 is lifted upward, the round stake 28 is lifted upward and removed.

The rectangular stake 38 is removed with the rectangular notch 26 in the same way as the round stake 28 is removed with the oblong notch 24. Notches with different dimensions are used to remove stakes with corresponding cross-sectional dimensions. In the preferred embodiment, two notches for removing stakes are provided. More or fewer notches may be provided.

Other than removing stakes, the tool 10 is also used to remove nails. The nail is positioned in the nail removal notch 18. The bar 14 is then rotated to remove the nail.

Furthermore and as discussed above, once the stakes are removed, the nail removal notch end 22 is inserted under the framework. The bar 14 is then used as a lever arm to pry the framework upward and away from the concrete. The taper end 20 is also used for prying.

Depending on the intended use, the tool 10 is sized differently. For example, for working on framework used for pouring concrete sidewalks and driveways, the tool 10 generally is about the same size as a standard crow bar. Other sizes could be used for working on sidewalk and driveway framework. For working on framework used for foundations and footings, the tool 10 is larger. For the larger tool 10, the bar 14 is longer; the extension 16 has a greater radius; the notches have different dimensions to conform with standard or non-standard stakes; and the nail removal notch end 22 and the stake contact plate 12 may extend further from the front side 30.

Of course, it should be understood that a wide range of changes and modifications can be made to the preferred embodiment described above. For example, a bar with an extension and a stake contact plate with only one notch may be used. Alternatively, a bar with a stake contact plate having two notches on the same side, but without the radius, may be used. Thus, it is intended that the foregoing detailed description be regarded as illustrative rather than limiting.

It is the following claims, including all equivalents, which are intended to define the scope of this invention.

I claim:

1. A tool for removing concrete framework comprising:

a bar including a first end with an extension at an angle to a body of the bar; and a rounded extension connected near said first end, the rounded extension having an extension width at least about twice as wide as a bar width, wherein the rounded extension has a narrow width and the extension width, the extension width closer to the first end than the narrow width.

2. The tool of claim 1 wherein the rounded extension comprises a cylinder shape.

3. The tool of claim 2 wherein the rounded extension comprises a notch.

4. The tool of claim 3 wherein the notch comprises an aperture parallel to the extension width.

5. The tool of claim 3 wherein the rounded extension comprises a hollow cylinder and the notch comprises a cut-out along the width of the hollow cylinder near a side positioned closer to a second end of the bar than the first end of the bar.

6. The tool of claim 2 wherein the rounded extension comprises a hollow cylinder, the extension width comprises a dimension substantially perpendicular to the bar, and a cross-section of the rounded extension in a plane defined by the extension width and parallel to the bar comprises a trapezoidal shape.

7. The tool of claim 1 wherein the rounded extension has a narrow width and the extension width, the extension width closer to the first end than the narrow width.

8. The tool of claim 1 wherein the bar comprises a crow bar including a tapered second end attached at an angle to the bar and wherein the extension is substantially perpendicular to the body.

9. The tool of claim 1 further comprising a stake contact element having first and second stake notches including first and second different dimensions, respectively.

10. The tool of claim 9 wherein the first stake notch comprises a substantially oblong shape and the second stake notch comprises a substantially rectangular shape.

11. The tool of claim 1 wherein the rounded extension comprises an extension with a rounded surface on a side opposite the extension, the extension comprising a nail removal notch.

12. The tool of claim 1 wherein the rounded extension connects to said bar so that a tangent line tangent to the bottom of the rounded extension is parallel to the first end.

13. A tool for removing concrete framework comprising:

a bar having a first end; and a rounded extension connected near said first end, the rounding extension having a notch on a rounded outer surface of the rounded extension;

wherein the rounded extension comprises a hollow cylinder and the notch comprises a cut-out along a width of the hollow cylinder near a side positioned closer to a second end of the bar than the first end of the bar.

14. The tool of claim 13 wherein the rounded extension has an extension width at least about twice as wide as a bar width.

15. The tool of claim 14 wherein the notch comprises an aperture parallel to the extension width.

16. A tool for removing concrete framework comprising:

a bar having a first end; and a rounded extension connected near said first end, the rounding extension having a notch on a rounded outer surface of the rounded extension;

wherein the rounded extension comprises a hollow cylinder, the rounded extension has an extension width comprising a dimension substantially perpendicular to the bar, and a cross-section of the rounded extension in a plane defined by the extension width and parallel to the bar comprises a trapezoidal shape.

17. The tool of claim 14 wherein the rounded extension has a narrow width and the extension width, the extension width closer to the first end than the narrow width.

18. The tool of claim 13 wherein the bar comprises a crow bar including a tapered second end attached at an angle to the bar and wherein the first end is attached at an angle to the bar.

19. The tool of claim 13 further comprising a stake contact element connected to the bar and having first and second stake notches including first and second different dimensions, respectively.

20. A tool for removing concrete framework comprising:

a bar having a first end;

a rounded extension connected near said first end, the rounding extension having a notch on a rounded outer surface of the rounded extension; and a stake contact element connected to the bar and having first and second stake notches including first and second different dimensions, respectively;

wherein the first stake notch comprises a substantially oblong shape and the second stake notch comprises a substantially rectangular shape.

21. The tool of claim 13 wherein the rounded extension comprises an extension with a rounded surface on a side opposite a nail removal notch.

22. The tool of claim 13 wherein the rounded extension connects to said bar so that a tangent line tangent to the bottom of the rounded extension is parallel to an nail removal notch extension from the first end.

* * * * *